United States Patent [19]

Arney

[11] Patent Number: 4,509,652

[45] Date of Patent: Apr. 9, 1985

[54] BAKER'S RACK

[76] Inventor: Neil E. Arney, 6474 Camelia Dr., San Jose, Calif. 95120

[21] Appl. No.: 464,955

[22] Filed: Feb. 8, 1983

[51] Int. Cl.[3] ..... A47F 3/14

[52] U.S. Cl. ..... 211/126; 108/109; 248/239; 248/240.4; 211/208; 211/187

[58] Field of Search ..... 211/126, 208, 71, 187, 211/106; 108/56.3, 108, 109; 248/239, 240.4

[56] References Cited

U.S. PATENT DOCUMENTS

| | | | |
|---|---|---|---|
| 3,199,683 | 8/1965 | Graswich | 211/208 X |
| 3,295,471 | 1/1967 | Cook | 211/106 X |
| 3,655,063 | 4/1972 | Landry | 211/71 |

FOREIGN PATENT DOCUMENTS

| | | | |
|---|---|---|---|
| 1253295 | 1/1961 | France | 248/239 |

*Primary Examiner*—William H. Schultz
*Assistant Examiner*—Blair M. Johnson
*Attorney, Agent, or Firm*—Allston L. Jones

[57] ABSTRACT

A rack assembly having rotationally mounted support members is disclosed herein. Each of the three embodiments of those members allows the next lower support member to be rotated into a vertical attitude to permit the insertion into the rack of an item which is greater in height than the spacing between adjacent support members.

Various means are included in each support member design for interacting with the tip of the flange of the next lower support member to selectively maintain it in vertical attitude. The interacting means discussed include an outwardly projecting medial portion on the underside of the flange, a shoulder in the normally vertical portion of the support means which interconnects the flange with the means for affixing the support member to the rack, and, where it is desirable to be able to support a string of support members in the vertical attitude, the medial portion discussed above is included with a tail piece which extends outward from the support member in opposition to the flange.

5 Claims, 10 Drawing Figures

BAKER'S RACK

BACKGROUND OF THE INVENTION

The present invention relates to baker's racks for trays and pans, and more particularly to racks in which the vertical spacing between tray and pan support members can be varied.

In a typical baker's rack, members for supporting the trays and pans are affixed to vertical supports and project inwardly from two sides in opposition to each other. The vertical spacing between these support members is typically two inches and non-variable. Additionally, the horizontal support flange of each support member also extends inwardly by typically two inches along the entire depth of the rack.

In the prior art the support members are either permanently affixed to the vertical supports by welding or rivits (U.S. Pat. Nos. 2,600,298 or 2,622,740), or are removably mountable on the vertical supports.

When a baker wishes to prepare an item which is taller than the spacing permitted between the support members of a typical rack, he must either locate the item inwardly from the sides of the tray before inserting the tray in the rack, or remove a sufficient number of the support members from the rack above the location in the rack which he has selected for placement of the tray. If he fails to do either of these, the item on the tray may be damaged by the inwardly extending support members above the selected location in the rack for the tray.

Each of the above-outlined approaches for use of the standard baker's rack for items of greater height than the spacing between tray support members are undesirable. The locating of the item inwardly from the sides of the tray results in an extra step and the unavailability of at least a 2 inch strip along each side of the tray. If the tray is a standard 16 inch wide tray, 25% of the surface of the tray is unuseable. If the baker happens to own racks which have removeable support members, he may remove them and avoid the restriction as to the available surface area of each tray, however, the removeable support members are typically not of a standard size or design from rack to rack, they tend to get lost, and often get bent so that they are no longer useable.

What is needed is a baker's rack which has means for tilting and retaining support members in a position tilted back toward the vertical supports without removing the support members from the rack. The present invention provides such a baker's rack.

SUMMARY OF THE INVENTION

In accordance with the illustrated embodiments, the present invention provides a rack in which the normally horizontal support members, or flanges, may be rotated to a vertical attitude and selectively retained in that position to accommodate items having a height which is greater than the spacing between adjacent support members.

Each rack includes at least four vertical supports spaced apart from each other. Additionally, there are a multiplicity of support members for holding pans or trays within the rack. Each support member spans the distance between two vertical supports in combination with additional support members adjacent to the first. Similarly, support members span the distance between the other vertical supports in opposition to those on the first pair of vertical supports.

Each support member for such a rack includes a support flange portion, a capture means for retaining the support member by the vertical supports, and interaction means for selectively maintaining the flange portion of the next lower support member mounted on the same pair of vertical support means in a substantially vertical position. Additionally, each support member also includes an interconnection means for joining the flange portion and the capture means one to the other.

In two embodiments of the support means an outwardly projecting medial portion is provided on the underside of the flange portion a selected distance from the intersection of the flange with the interconnection means to selectively interact with the free end of the flange of the lower adjacent support member in the vertical attitude. One of these embodiments also includes a tail piece extending outwardly from the interconnection means in opposition to the flange portion. The purpose of the tail piece is to interact with the free end of the flange of the lower adjacent support member to maintain same in the vertical attitude. Through the use of the tail piece it is possible to maintain a string of the support members in the vertical attitude.

The third embodiment of the support member includes a shoulder in the interconnection means for spacing the lower portion of the interconnection means away from the vertical supports. The spaced apart distance is substantially equal to the thickness of the flange portion to permit interaction with the free end of the flange of the lower adjacent support member within that space to maintain same in the vertical attitude.

DESCRIPTION OF THE PREFERRED EMBODIMENT

Figure 1:
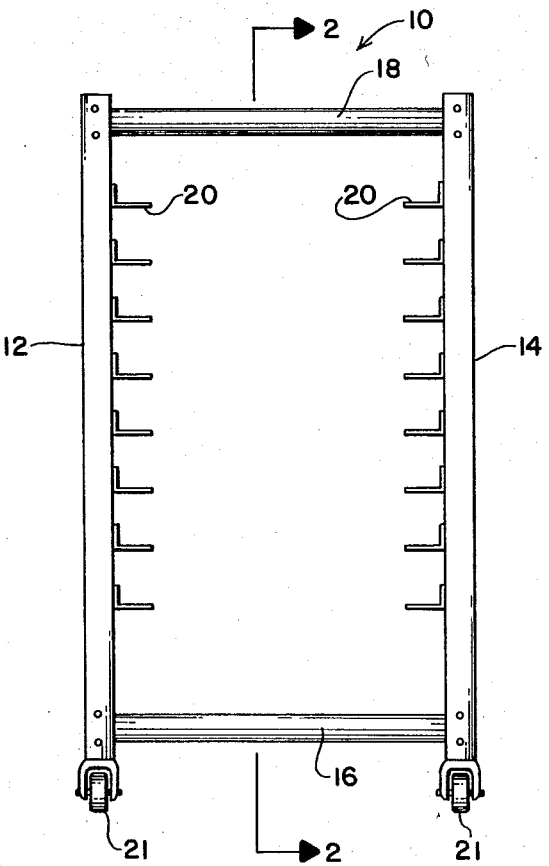
FIG. 1 is a plane front view of a single bay baker's rack of the present invention.

Referring to FIG. 1 there is shown a front view of a portable single bay baker's rack 10. This rack includes a lower tubular rail 16 and an upper tubular rail 18 each being interconnected between vertical support 12 and 14 at the bottom and top of each respectively. In addition, the ends of a multiplicity of tray support members 20 which are affixed to vertical supports 12 and 14 can be seen. The entire rack 10 is supported on swivel casters 21.

Figure 2:
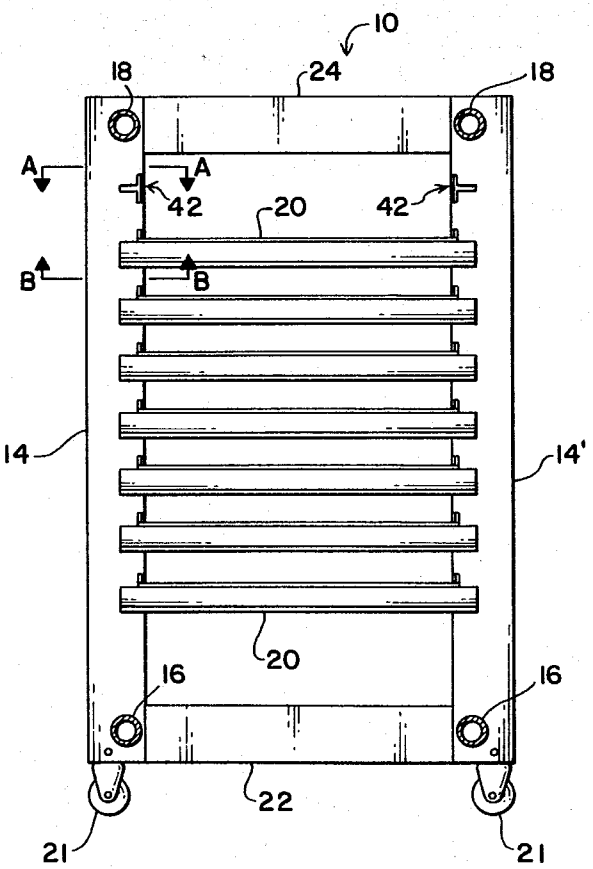
FIG. 2 is a plane interior side sectional view of the rack of FIG. 1 taken on line 2—2.

FIG. 2 is a representative view of the interior side section of rack 10 taken along line 2—2 in FIG. 1. Each of the side sections of rack 10 include a lower side rail 22 and an upper side rail 24 which interconnect with the vertical supports 14 and 14' at the lower and upper ends thereof respectively. Additionally a multiplicity of tray support members 20 are shown mounted between vertical supports 14 and 14'. The uppermost tray support member 20 shown in FIG. 1 has been omitted in FIG. 2 to illustrate the T-shaped slot 42 in each of vertical supports 14 and 14' in which a tray support member 20 would be mounted. The mounting of tray support members 20 in slots 42 will be discussed further in relation to FIGS. 5 through 8.

Figure 3A:
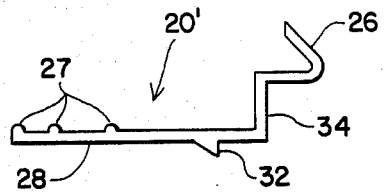
FIGS. 3*a* and 3*b* are end views of two support members of the present invention for use in the baker's rack of FIG. 1.
Figure 3B:
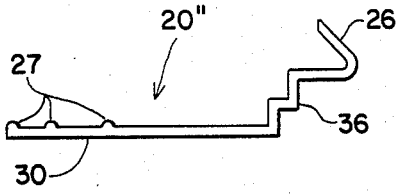
Figure 4:
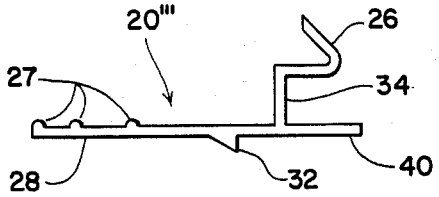
FIG. 4 is an end view of a third support member of the present invention for use in the baker's rack of FIG. 1.

FIGS. 3*a*, 3*b* and 4 show end views of three tray support members 20 for use with rack 10. FIGS. 3*a* and 3*b* show tray support members 20' and 20'', respectively, for mounting within a T-shaped slot 42, and tray support member 20''' of FIG. 4 is mountable in a modified T-shaped slot to be discussed in relation to FIGS. 6 and 8. Each of the variations of tray support member 20 shown in FIGS. 3*a*, 3*b* and 4 are designed to be extruded of a suitable material, such as steel or aluminum, to reduce the otherwise necessary machining or bending costs.

Tray support members 20' of FIGS. 3*a* and 20''' of FIG. 4 are identical with the exception of the added tail piece 40 on tray support member 20'''. The function of tail piece 40 on tray support 20''' will become clear in relation to the discussions with respect to FIGS. 6 and 8. Each of tray support members 20 include a V-shaped support hook 26 for interfacing with T-shaped slot 42 and beads 27 on the top surface of flanges 28 and 30. The purpose of beads 27 is to support the tray (not shown) that is mountable within rack 10 above the surface of the flange itself to minimize the possibility of the tray sticking to the flange. Tray support members 20' and 20''' also include an interconnection piece between flange 28 and V-shaped support hook 26, and an outwardly projecting medial portion 32 on the underside of flange 28 spaced apart from the point of interconnection of that flange with interconnection piece 34. In FIGS. 3*a* and 4 the outwardly projecting medial portion is shown as being triangular, however, a large bead similar to bead 27 would also function in the same way as would any other shape. (See FIGS. 7 and 8.) Tray support member 20'' is distinguishable from members 20' and 20''' because of its longer flange 30, its stepped interconnection piece 36, and its lack of outwardly projecting medial portion 32 on the under side of flange 30.

Figure 5:
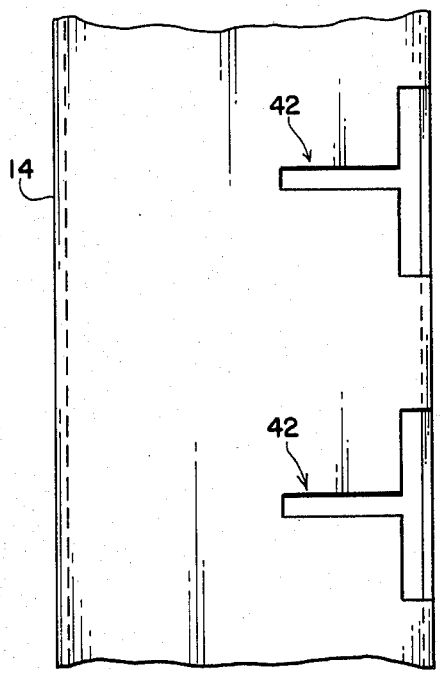
FIG. 5 is a vertical section of a vertical support of the baker's rack of the present invention being taken between lines A—A and B—B of FIG. 2 showing the mounting detail for the support members of FIGS. 3*a* and 3*b*.
Figure 6:
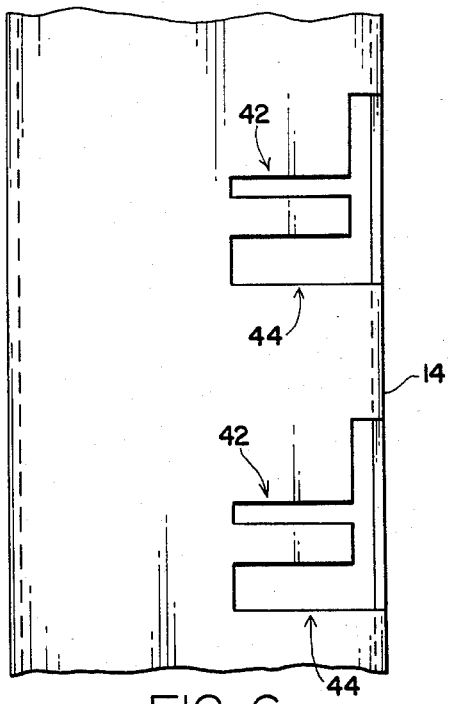
FIG. 6 is a vertical section of a vertical support of the baker's rack of the present invention being taken between lines A—A and B—B of FIG. 2 showing the mounting details for the support member of FIG. 4.

Referring now to FIGS. 5 and 6 there is shown in each of these Figures a portion of vertical support 14 taken between lines A—A and B—B of FIG. 2 to better show the T-shape slot 42 and the addition of the rectangular slot 44. Both slot 42, and the combined slots 42 and 44 operate in substantially the same manner. Tray supports 20' and 20'' are mountable in either the single slot 42 or the combined slots 42 and 44, however, for these members there is no need for secondary slot 44. Secondary slot 44 is included to accommodate tail piece 40 of tray support member 20''' and, therefore, this member may only be mounted in the dual slot combination shown in FIG. 6. To insert any of the tray support members 20 into slot 42 within each of the vertical support 12 and 14 the tray support member 20 is held with the flange portion 28 or 30 in a vertical plane and then the free end of the V-shaped support hook 26 is inserted in the horizontal portion of T-shaped slot 42 within each of the vertical supports 12 and 14. With the free end of V-shaped support hook 26 fully inserted within slot 42, the flange of tray support member 20 can be rotated away from vertical supports 12 and 14 so that the flange portion 28 or 30 is in a horizontal plane as shown in the bottom portion of each of FIGS. 7*a*, 7*b* and 8. In this position the free end of V-shaped support hook 26 comes in contact with the opposite surface of vertical support 12 or 14 above the horizontal portion of slot 42, and the interconnection piece 34 or 36 comes into contact with the opposite side of vertical support 12 or 14, therefore, providing the retention and support necessary for flanges 28 or 30 to support the trays within the rack.

Figure 8:
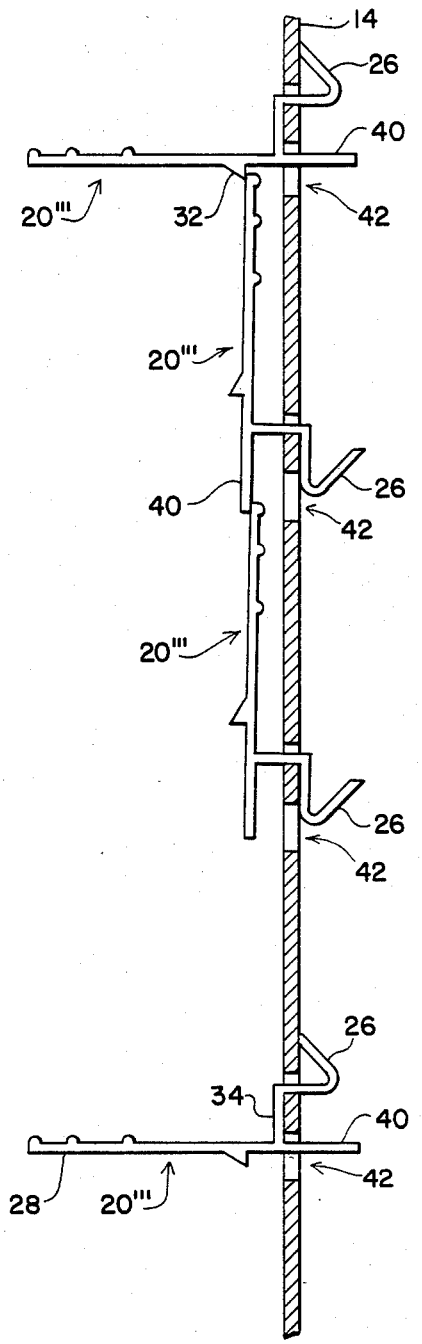
FIG. 8 is a simplified plane view showing selected support members of the type shown in FIG. 4 being retained in a tilted, out of the way, position.

In the case of tray support members 20''', as can be seen in FIG. 8, when the member is rotated through 90° to place flange 28 in a horizontal position, tail piece 40 passes through slot 44 as can be seen in the lower portion of FIG. 8.

Figure 7B:
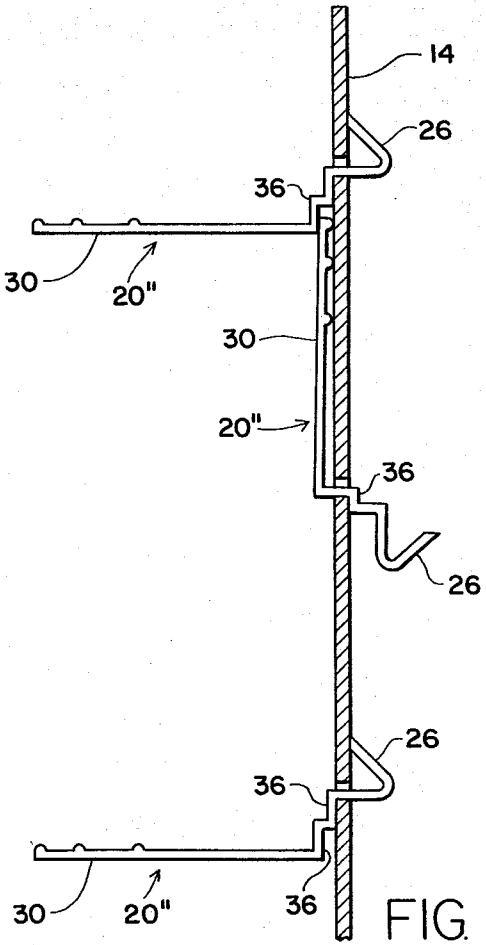
FIGS. 7*a* and 7*b* are simplified plane views showing selected support members of the type shown in FIGS. 3*a* and 3*b* being retained in a tilted, out of the way, position.
Figure 7A:
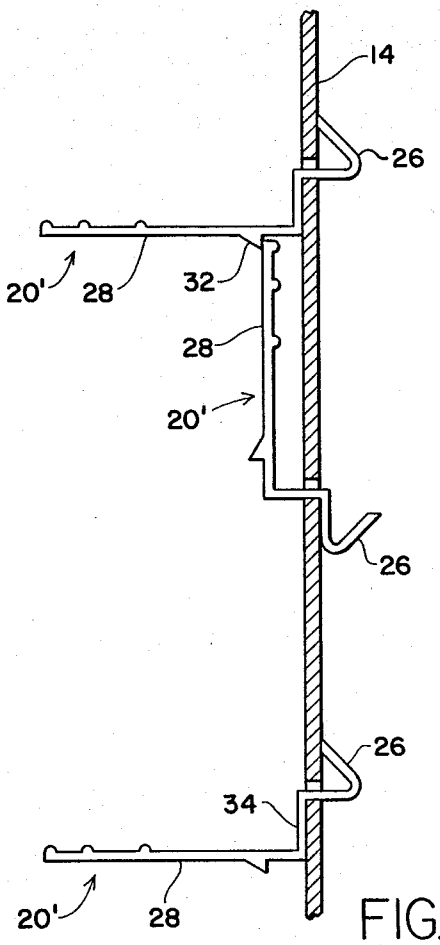

Referring now to FIG. 7*a* it can be seen that by rotating one of tray support members 20' through 90° and passing the tip of flange 28 of that member behind outwardly projecting medial portion 32 of the support member 20' above, the flange portion of the lower member 20' will be maintained in a vertical position thus allowing double the spacing between adjacent useable support members 20'. In FIG. 7*b* the tray support members 20'' are supported in a vertical position in a similar fashion. In this figure it can be seen that while turning a lower support member 20'' so that its flange 30 becomes vertical one need only momentarily lift the flange portion of the support member 20'' above to capture the tip of flange 30 of the lower support member below the shoulder of the stepped region of interconnection piece 36. Thus it can be seen that through the use of tray support members 20' or 20''' it is possible to move every other tray support member into a vertical position and thus allow additional space between the then adjacent tray support members 20.

The rotation of a string of tray support members 20 into a vertical, and out of the way position, can be accomplished through the use of tray support members 20'''. In referring to FIG. 8 one can see that the combination of outwardly projecting medial portion 32 and tail piece 40 makes it possible to swivel into that horizontal position a string of tray support members 20''', and thus to provide even greater spacing between the trays to be mounted within rack 10. This is accomplished by first swiveling one tray support member 20''' into the vertical position with its tip passing behind the outwardly projecting medial portion 32 which is spaced apart from interconnection piece 34. Next, while swiveling the next lower tray support member 20''' into the vertical position, one must temporarily push the end of the first vertically placed tray support member 20''' toward vertical support 14 to allow the tip of the flange 28 of the second vertically placed tray support member 20''' to pass behind tail piece 40 on the first vertically placed tray support member 20'''. This process could then be continued to support additional tray support members 20''' in the vertical configuration.

It will be obvious to one skilled in the art that the techniques described herein are by no means limited to a single bay baker's rack as shown in FIG. 1 and may easily be extended to multiple bay baker's racks. Further, from the foregoing description, it will also be apparent that additional configurations of the tray support members 20 may be provided to perform the same function without departing from the spirit or essential characteristics of the invention herein disclosed.

I claim:

1. A rack comprising:

first and second pairs of vertical support means;

interconnection means for selectively spacing apart said first and second pairs of vertical support means one from the other and for selectively spacing apart each vertical support means within each pair of said vertical support means one from the other with said first pair of vertical supports being opposite and aligned with said second pair of vertical supports;

each of said vertical support means defining a multiplicity of slot means therewithin in the surface of said vertical support means facing the opposite vertical support means in the other pair thereof; and a multiplicity of support members rotationally mountable within the slot means of, and extendable between, the pair of vertical support means of either of said first and second pair of vertical support means;

each of said support members includes:

a support flange portion;

capture means for retaining the support member within the slot means of the vertical support means with said flange in any position within its rotatable range;

interconnection means for joining said flange means and capture means of said support member and for abutting the outer surface of said vertical support means to, in conjunction with said capture means, support the flange portion in a horizontal attitude; and interaction means for selectively maintaining the flange portion of the next lower support member mounted on the same pair of vertical support means in a substantially vertical position, said interaction means includes an outwardly projecting medial portion on the underside of the flange portion spaced apart from the intersection of said flange means with the interconnection means a distance at least equal to the thickness of the flange to selectively interact with the free end of the flange of the lower adjacent support member to maintain same in the vertical attitude while the flange portion of the upper adjacent support member remains in a horizontal attitude.

2. A rack as in claim 1 wherein said interaction means further includes tail piece means outwardly extending from the interconnection means in opposition to the flange portion for interacting with the free end of the flange of the lower adjacent support member to maintain same in the vertical attitude by a support member having its flange portion in the vertical attitude.

3. A support member for rotational mounting and spanning a distance between vertical supports one above the other, said support member comprising:

a flange portion;

capture means for rotationally affixing said support member to said vertical supports;

interconnection means for joining said flange portion and said capture means; and interaction means for selectively maintaining the flange portion of the next lower support member mounted on the vertical supports in a substantially vertical position, said interaction means includes and outwardly projecting medial portion on the underside of the flange portion spaced apart from the intersection of said flange means with the interconnection means a distance at least equal to the thickness of the flange to selectively interact with the free end of the flange of the lower adjacent support member to maintain same in the vertical attitude while the flange portion of the upper adjacent support member remains in a horizontal attitude.

4. A support member as in claim 3 wherein said interaction means further includes tail piece means outwardly extending from the interconnection means in opposition to the flange portion for selectively interacting with the free end of the flange of the lower adjacent support member to maintain same in the vertical attitude by a support member having its flange portion in the vertical attitude.

5. A rack as in claim 1 wherein said capture means includes hook means for extending through said slot means and abutting the inner surface of said vertical support means.

* * * * *